US005373638A

United States Patent [19]

Coffin

[11] Patent Number: 5,373,638

[45] Date of Patent: Dec. 20, 1994

[54] RAZOR HEAD, ESPECIALLY RAZOR BLADE UNIT OF A WET RAZOR

[75] Inventor: Dave Coffin, Norwich, United Kingdom

[73] Assignee: Warner-Lambert Company, Morris Plains, N.J.

[21] Appl. No.: 56,024

[22] Filed: Apr. 30, 1993

[30] Foreign Application Priority Data

May 2, 1992 [DE] Germany ..... 9205955

[51] Int. Cl.[5] ..... B26B 21/00

[52] U.S. Cl. ..... 30/50

[58] Field of Search ..... 30/32, 47, 50, 57, 75, 30/80

[56] References Cited

U.S. PATENT DOCUMENTS

| | | | |
|---|---|---|---|
| 3,890,704 | 6/1975 | Ferraro . | |
| 4,069,580 | 1/1978 | Cartwright et al. | 30/50 |
| 4,345,374 | 8/1982 | Jacobson | 30/50 |
| 4,970,784 | 11/1990 | Althaus et al. | 30/50 |
| 5,070,612 | 12/1991 | Abatemarco | 30/50 |
| 5,070,613 | 12/1991 | Althaus et al. . | |
| 5,161,307 | 11/1992 | Althaus | 30/50 |
| 5,251,376 | 10/1993 | Althaus | 30/50 |

FOREIGN PATENT DOCUMENTS

| | | |
|---|---|---|
| 2737323 | 8/1977 | Germany . |
| 3049513 | 12/1980 | Germany . |
| 3139693 | 4/1982 | Germany . |

*Primary Examiner*—Richard K. Seidel

*Attorney, Agent, or Firm*—Robert W. Becker & Associates

[57] ABSTRACT

A razor head, in particular a razor blade unit for a wet razor, arranged at the front end of a razor handle. Single or twin razor blades are arranged in a plastic housing, with the razor blades being fixed to a plastic spacer to form a razor blade(s)/spacer unit. In order to improve the fixing of the razor blades to the spacer, the razor blades are fixed to the spacer by means of adhesive.

14 Claims, 1 Drawing Sheet

1
3
4
6
6'
8
9
3"
III
IV 1
3
4
3"
3'
6
7

2
3'
3"
4
5
10
11

2
3'
3"
4
5
10
11

RAZOR HEAD, ESPECIALLY RAZOR BLADE UNIT OF A WET RAZOR

BACKGROUND OF THE INVENTION

1.Field of the Invention

The present invention relates to a razor head arranged on the front end of a razor handle, and in particular to a razor blade unit of a wet razor, whereby a single or twin razor blade is arranged in a plastic housing, the razor blade or blades being fixed to a plastic spacer to form a razor blade(s)/spacer unit.

2. Description of Related Art

Wet razors where the razor head is arranged at the front end of a razor head are known. When the razor head is a separate component that is removable from the razor handle, it is known as a so-called razor blade unit.

A known razor head in the form of a razor blade unit has a plastic housing in which is arranged a twin razor blade. The two razor blades are fixed to a plastic spacer to form a razor blade/spacer unit, which in turn is fixed in the plastic housing. In order to fix the razor blades to the spacer, the razor blades are provided with perforations through which plastic rivets of the spacer project.

The drawback of this known razor blade unit is that the fixing of the razor blades to the spacer by means of plastic rivets results in the loss of bonding strength of the blade means over time, since the plastic spacer and hence the razor blades can become loose while shaving, so that the shaving or razor geometry changes disadvantageously during the shave. A further drawback is that the razor blades are susceptible to corrosion.

SUMMARY OF THE INVENTION

It is therefore an object of the present invention to improve the fixing of the razor blades to the spacer.

To realize this object, the inventive razor head is characterized primarily in that the razor blade or blades are fixed by adhesion to the spacer.

A razor head formed according to this technical teaching, in particular a razor blade unit of a wet razor, has the advantage that the razor blades that are to be fixed and secured to the spacer do not need to have any perforations; thus, the razor blade body is not weakened. As a result, the intended shaving geometry is maintained. Since pursuant to the present invention the razor blades are fixedly adhered to the spacer, the danger that the bonding between the razor blades and the spacer could gradually become loosened, as is the case when fixing with plastic rivets, is prevented. Thus, even with prolonged use, the blades cannot move relative to the spacer, so that the intended shaving geometry continues to be maintained with prolonged use. The spacer can be provided as a molded plastic part, the advantage of which is that a design in the form of a molded part provides the known range of design parameters. Plastic molded parts can, with today's technology, be so manufactured, that for a twin razor blade unit the desired distance of, for example, 0.5 mm between the blades can be precisely maintained, which leads to the desired high precision of the shaving geometry.

The manufacturing costs of a plastic spacer are furthermore small when a multi-impression tool (32 to 64 impressions) is used.

In order to ensure the most accurate spacer distance possible, the unavoidable molding ejector pins are disposed on fewer working surfaces. Furthermore, it is readily conceivable to provide the plastic spacer with other functional parts, for example pivoting guides, spring elements or control levers.

Pursuant to one preferred proposed embodiment, the spacer has flat surfaces on which the razor blade or blades are fixedly adhered. The flat surfaces of the spacer offer the advantage that large areas of the razor blades rest on the spacer and at the same time form the adhesive surfaces. The razor blades and the spacer thereby rest extensively on one another in the area of these flat surfaces. This ensures not only a strong holding force between the razor blades and the spacer, but also that the desired shaving geometry is maintained. In particular, a precise distance or spacing between the razor blades is maintained by means of the formation of the flat adhesive surfaces on the spacer.

In another preferred embodiment, it is proposed that an area of the spacer to which razor blades are not fixed be provided with additional surfaces for the required molding ejector pins or the like. This is a particularly important aspect of the present invention. The basic idea of this embodiment consists in that each surface of the spacer to which the razor blades are to be adhered is, as far as possible, made without being influenced by wear and tear. In this way, for example in the use of twin blades, the distance between the two blades is always precisely maintained so that the optimum shaving geometry is ensured. The surfaces that define this spacing or distance are thus free from the unavoidable molding ejector pins and are also free from burrs that affect the distance. Such pins and the like can be provided on surfaces of the spacer having less importance, for example on lugs on the rear side.

Pursuant to a further embodiment, it is proposed that the spacer comprise a basic spacer body in the form of a strip on which at least one spacer element for the razor blade or blades is formed. This provides a straightforward construction of the spacer, whereby the flat spacer element or elements project from the basic spacer body, and the free ends of the spacer element or elements as well as the cutting edges of the razor blades are appropriately oriented and aligned. The spacer elements are preferably bevelled or inclined towards the base at their front, projecting ends in conformity with the staggered arrangement of the two razor blades.

Pursuant to one specific embodiment, it is proposed that a plurality of spacer elements be distributed over the length of the basic spacer body. Thus, for example, six such elements can be provided. This is sufficient to provide the required support surface for the razor blades.

Pursuant to a further embodiment, it is proposed that perforations that open in the direction of shaving be provided between each spacer element. This embodiment has the advantage that the cleaning as well as the removal of shaving debris from between the two blades is improved. It is to be understood that the plastic housing has perforations or spacings that correspond to these perforations between the spacer elements.

A further embodiment proposes that the width of the spacer elements corresponds essentially to the width of the perforations. This presents a weighed relationship as well as a compromise between a good support of the razor blades on the spacer elements and a good removal of the shaving debris during the shave.

In a further embodiment, it is proposed that the spacer have an L or Z-shaped profile. This avoids a lengthwise deformation, which is an important requirement for a technically fault-free feeding of sorting machines.

In a further proposed embodiment, the spacer is provided with positioning elements for the razor blade or blades. This ensures that the razor blades are precisely securely adhered to the spacer in the required position. The positioning elements can be formed as grooves in the spacer and can have an essentially trough-shaped form, in which the razor blades are located.

Pursuant to a further proposed embodiment, the spacer is provided with positioning elements for locating the razor blade(s)/spacer unit in the plastic housing. The positioning elements can be formed by grooves or recesses formed at the ends of the spacer. These positioning elements have the advantage that the razor blade(s)/spacer unit can be accurately positioned in the plastic housing in precisely the required position so that in cooperation with the front guardbar and the rear cover cap of the plastic housing, the required shaving geometry is precisely maintained.

In a further embodiment, it is proposed that the razor blade or blades be used in connection with an aluminum part or a wire part. The aluminum part or small wire part is disposed over the two razor blades and solves the problem of preferential anodic corrosion.

Alternatively, it is also conceivable for the razors blades to be made of a corrosion resistant steel so that additional corrosion resistance measures can be dispensed with.

In a preferred embodiment of the spacer, it is proposed that it be made from polystyrene or ABS (acrylonitrile-butadiene-styrene). The preferred employed material is ABS, which ensures a quick achievement of the initial strength that is required for assembly, but has a final strength that is less than that of polystyrene. Of course, other plastics could also be used.

Finally it is proposed in a further embodiment that the adhesive be a cyanoacrylate adhesive. This adhesive is free from solvent, is quick drying, and has a high resistance to water and soap. By means of this adhesive, with which a strength of 6 $N/mm^2$ can be achieved, it is possible, subject to the adhesion surfaces that are available, to achieve strengths that are superior to the strength of the molded version. Negative influences from structural changes are not applicable, and as a result of these particular properties of the solvent free adhesive there are no corrosion-triggering reactions.

It is to be understood that both this general description of advantageous embodiments and the following detailed description are exemplary and explanatory only and are not restrictive of the invention as claimed.

BRIEF DESCRIPTION OF THE DRAWINGS

One exemplary embodiment of a razor head according to the invention in the form of a razor blade unit of a wet razor will now be described in greater detail, by way of example only, with reference to the accompanying schematic drawings, in which.

DESCRIPTION OF PREFERRED EMBODIMENTS

Figure 1:
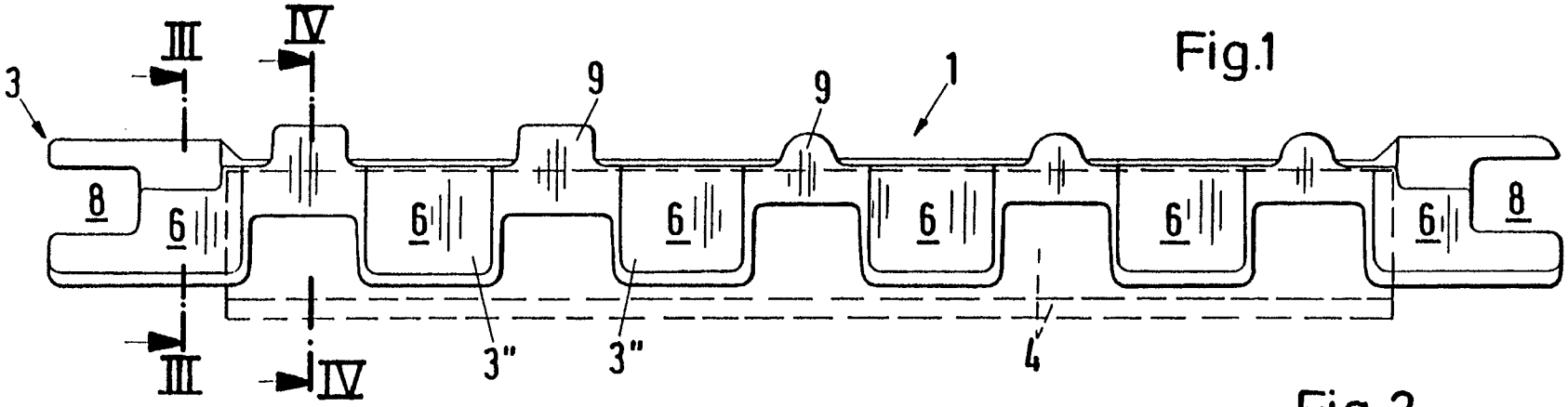
FIG. 1 is a top view of the razor blade (s)/spacer unit of the razor blade unit.
Figure 2:
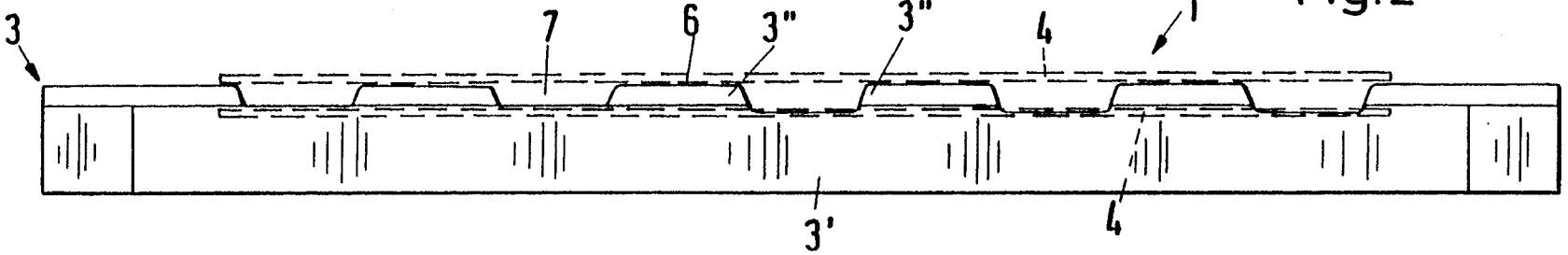
FIG. 2 is a front view of the razor blade (s)/spacer unit of FIG. 1.
Figure 4:
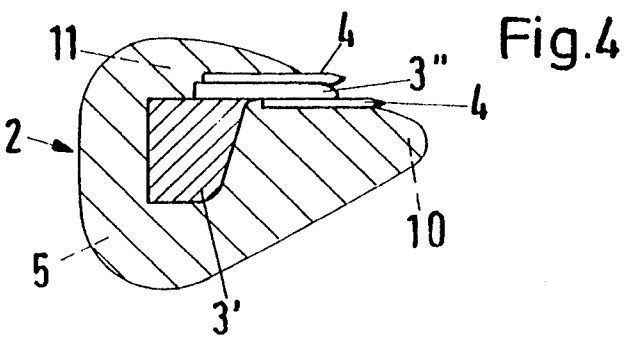
FIG. 4 is a cross-sectional view taken along the line IV—IV in FIG. 1, wherein the plastic housing of the razor blade unit is again indicated.
Figure 3:
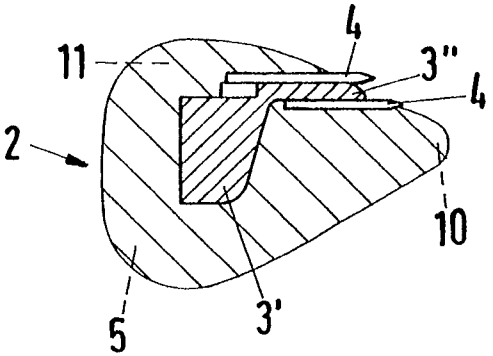
FIG. 3 is a cross-sectional view taken along the line III—III in FIG. 1, wherein the plastic housing of the razor blade unit is also indicated.

In FIGS. 1 and 2, a razor blade(s)/spacer unit 1 of a razor blade unit 2 is shown, wherein the spacer 3 is shown by solid lines and the razor blades 4 are shown by broken lines for improved clarity. In FIGS. 3 and 4, the spacer 3 as well as the razor blades 4 are shown with unbroken lines, whereas additionally, though not shown in FIGS. 1 and 2, the plastic housing 5 of the razor blade unit 2 is also shown.

The spacer 3 is a plastic molded part and comprises a strip-shaped basic spacer body 3'. Six spacer elements 3'' that project in a forward direction are formed on the upper region of the spacer body 3'. The middle four spacer elements 3'' have an essentially square shape, while the two outer spacer elements 3'' have an essentially L-shape. As is particularly noticeable from FIGS. 3 and 4, the spacer elements 3'' are bevelled at the front and sloped towards the base. The upper sides and the lower sides of the spacer elements 3'' are formed as level or flat surfaces which are exactly parallel to one another, with the thickness of the spacer elements 3'' being exactly 0.5 mm. As is particularly noticeable from the sectional views of FIGS. 3 and 4, a respective razor blade 4 is fixedly adhered to the upper and to the lower flat surface 6 of the spacer elements 3''. A cyanoacrylate adhesive is used as the adhesive. The two razor blades 4 are thereby arranged exactly parallel to one another as well as staggered one behind the other.

The razor blade(s)/spacer unit 1 is provided with perforations 7 between the spacer elements 3'', so that a passageway is created between the two razor blades 4. The ends of the razor blade(s)/spacer unit 1 are provided with inwardly directed grooves or recesses 8 parallel to the basic spacer body 3' and in the region of the two outer spacer elements 3'' ; these grooves 8 serve as locating elements for the razor blade(s)/spacer-unit 1 inside the plastic housing 5. The reverse or rear side of the basic spacer body 3' of the spacer 3 is provided with further projecting lugs 9, which are the few important functional surfaces against which the unavoidable molding ejector pins can be positioned. The spacing-defining flat surfaces 6 are therefore free from the ejector pins or free from burrs that influence the spacing, so that, on completion, the flat surfaces 6 are maintained as far as possible precisely at 0.5 mm and are not influenced by wear. This ensures the high accuracy of the shaving geometry.

The thus formed razor blade(s)/spacer unit 1 is placed in the plastic housing 5, with the grooves 8 at each end serving as positioning elements. The plastic housing 5 has the usual forward guardbar 10 as well as the rear cover cap 11, so that the razor blade(s)/spacer unit 1 is held immovably within the plastic housing 5. The adhesive fixing of the razor blades 4 to the spacer elements 3'' provides the advantage that the razor blades 4 are at all times fixed to the spacer 3, without the risk of loosening, which is the case with the use of plastic rivets, for example. This further provides a high positional accuracy for the razor blades and hence maintains the precise shaving geometry during extended use.

The present invention is, of course, in no way restricted to the specific disclosure of the specification and drawings, but also encompasses any modifications within the scope of the appended claims.

What I claim is:

1. A razor head that is intended to be disposed at the end of a handle, said razor head comprising:

a plastic housing; and a razor blade/spacer unit that is disposed in said plastic housing and includes a plastic spacer and razor blade means fixed to said spacer by means of adhesive, wherein said spacer is provided with flat surfaces to which said razor blade means is fixed, and wherein said spacer has a portion that is free of said razor blade means and that is provided with at least one additional surface for ejector pins that are require during a molding process, said at least one additional surface being in the form of a projecting lug against which said molding process ejector pins are adapted to be positioned.

2. A razor head according to claim 1, wherein said spacer comprises a strip-shaped basic spacer body from which projects at least one spacer element that is provided with said flat surfaces for said razor blade means.

3. A razor head according to claim 2, wherein a plurality of said spacer elements are distributed over the length of said basic spacer body.

4. A razor head according to claim 3, wherein a respective perforation that opens out in a direction of shaving is provided between each two adjacent spacer elements.

5. A razor head according to claim 4, wherein said perforations and said spacer elements have essentially the same width.

6. A razor head according to claim 4, wherein said spacer has an L or Z-shaped profile.

7. A razor head according to claim 4, wherein said spacer is provided with positioning means for said razor blade means.

8. A razor head according to claim 4, wherein said spacer is provided with positioning elements for positioning said razor blade/spacer unit in said plastic housing.

9. A razor head according to claim 8, wherein said positioning elements are grooves formed at ends of said spacer.

10. A razor head according to claim 4, wherein said razor blade means is in contact with an aluminum part or a wire part.

11. A razor head according to claim 4, wherein said razor blade means is made of corrosion resistant steel.

12. A razor head according to claim 4, wherein said spacer is made of one of the group consisting of polystyrene and ABS.

13. A razor head according to claim 4, wherein said adhesive is a cyanoacrylate adhesive.

14. A razor head according to claim 4, wherein each said projecting lug is disposed on a side of said portion of said spacer that is remote from said direction of shaving, and wherein said projecting lugs are staggered relative to said spacer elements and across from said perforations.

* * * * *